US010711664B2

(12) United States Patent
Müller

(10) Patent No.: US 10,711,664 B2
(45) Date of Patent: Jul. 14, 2020

(54) VALVE TRAIN HAVING A SLIDING CAM ELEMENT

(71) Applicant: ThyssenKrupp Presta TecCenter AG, Eschen (LI)

(72) Inventor: Ulf Müller, Chemnitz (DE)

(73) Assignee: THYSSENKRUPP PRESTA TECCENTER AG, Eschen (LI)

( * ) Notice: Subject to any disclaimer, the term of this patent is extended or adjusted under 35 U.S.C. 154(b) by 853 days.

(21) Appl. No.: 15/320,382

(22) PCT Filed: Jul. 1, 2015

(86) PCT No.: PCT/EP2015/064930
§ 371 (c)(1),
(2) Date: Dec. 20, 2016

(87) PCT Pub. No.: WO2016/001274
PCT Pub. Date: Jan. 7, 2016

(65) Prior Publication Data

US 2017/0138231 A1 May 18, 2017

(30) Foreign Application Priority Data

Jul. 2, 2014 (DE) ..... 10 2014 109 243

(51) Int. Cl.
*F01L 13/00* (2006.01)
*F01L 1/18* (2006.01)
*F01L 1/04* (2006.01)

(52) U.S. Cl.
CPC ..... *F01L 13/0036* (2013.01); *F01L 1/042* (2013.01); *F01L 1/181* (2013.01); *F01L 1/185* (2013.01);
(Continued)

(58) Field of Classification Search
CPC ... F01L 13/0036; F01L 13/0063; F01L 1/042; F01L 1/181; F01L 2013/0052; F01L 2105/00
(Continued)

(56) References Cited

U.S. PATENT DOCUMENTS 4,516,542 A * 5/1985 Aoyoma ..... F01L 1/181 123/198 F
2011/0180029 A1* 7/2011 Arnold ..... F01L 13/0005 123/90.17

FOREIGN PATENT DOCUMENTS

DE 2753197 A1 6/1978
DE 3319755 A1 12/1983
(Continued)

OTHER PUBLICATIONS

English translation of International Search Report for International Patent Application No. PCT/EP2015/064930; dated Oct. 2, 2015.
(Continued)

*Primary Examiner* — Mark A Laurenzi
*Assistant Examiner* — Loren C Edwards
(74) *Attorney, Agent, or Firm* — thyssenkrupp North America, LLC

(57) ABSTRACT

A valve drive may include a sliding cam element that is held on a carrier shaft so as to be axially displaceable along an axis of rotation of the carrier shaft. The sliding cam element may include at least one cam profile group with cam profile sections of mutually different form. The valve drive may further include a pick-off element by way of which a control movement can be picked off from the cam profile sections and transmitted to a valve. The sliding cam element may also include a second cam profile group that is similar or identical to the first cam profile group and, which for the joint control of one valve, may interact with the pick-off element.

18 Claims, 2 Drawing Sheets

(52) U.S. Cl.
CPC ... *F01L 2013/0052* (2013.01); *F01L 2105/00* (2013.01)

(58) Field of Classification Search
USPC ..... 123/90.15, 90.16, 90.17, 90.18
See application file for complete search history.

(56) References Cited

FOREIGN PATENT DOCUMENTS

| | | | |
|---|---|---|---|
| DE | 4142197 | A1 | 4/1993 |
| DE | 102006058093 | A1 | 6/2008 |
| DE | 102007010155 | A1 | 9/2008 |
| DE | 102007020128 | A1 | 10/2008 |
| DE | 102010011828 | A1 | 9/2011 |
| DE | 102012103751 | A1 | 10/2013 |

OTHER PUBLICATIONS

English Language Abstract for DE4142197A1.
English Language Abstract for DE102007020128A1.

* cited by examiner

VALVE TRAIN HAVING A SLIDING CAM ELEMENT

CROSS REFERENCE TO RELATED APPLICATIONS

This application is a U.S. National Stage Entry of International Patent Application Serial Number PCT/EP2015/064930, filed Jul. 1, 2015, which claims priority to German Patent Application No. DE 10 2014 109 243.0 filed Jul. 2, 2014, the entire contents of both of which are incorporated herein by reference.

FIELD

The present disclosure generally relates to valve drives, including valve drives that have sliding cam elements.

BACKGROUND

DE 10 2007 010 155 A1 presents a valve drive having a sliding cam element arranged on a carrier shaft, and the sliding cam element can be displaced axially in the axis of rotation of the carrier shaft. On the sliding cam element there is mounted a cam profile group which has different cam profile sections. Depending on the axial position of the sliding cam element, a pick-off element, illustrated as a roller-type rocker lever, can interact with differently contoured cam profile sections of the cam profile group, such that the valve is actuated in a manner dependent on the selected cam profile section. For example, the cam profile sections can be differently contoured such that the valve can perform opening strokes of different magnitude or different length. The roller-type rocker lever has a roller, and on the side averted from the valve, the roller-type rocker lever is supported by way of a valve play compensation element.

The contact between the roller of the roller-type rocker lever and the cam profile section necessitates a minimum width owing to the actuation forces of the valve, and linear contact is formed between the roller and the cam profile section, which linear contact must thus have a minimum length. If the roller is selected to be too narrow, the Hertzian stresses on the surface of the cam profile section become too high, and premature fatigue or surface wear of the valve drive can occur. It is thus disadvantageously necessary for the sliding cam element to be formed with a minimum width which is determined at least by the required width of the cam profile sections, such that a minimum displacement length of the sliding cam element also becomes necessary in order to change over the cam profile section in contact with the roller. However, a sliding element of wide form lengthens the switching times for switching between different cam profile sections in operative connection with the pick-off element, wherein it is basically sought to provide a valve drive in which the fastest possible changeover of the cam profile sections in contact with the pick-off element is possible. In particular in the case of high rotational speeds of an internal combustion engine, the sliding cam element must be moved axially between two positions in very short times, such that a design of a sliding cam element of narrow construction would be expedient.

DE 10 2007 020 128 A1 presents a pick-off element having two rollers which are in contact with a single cam element. Here, the two rollers, which are arranged spaced apart from one another, effect guidance of a receiving rocker which lies in a cam follower and which permits tilting compensation of the cam follower relative to the cam element.

DETAILED DESCRIPTION

Figure 1:
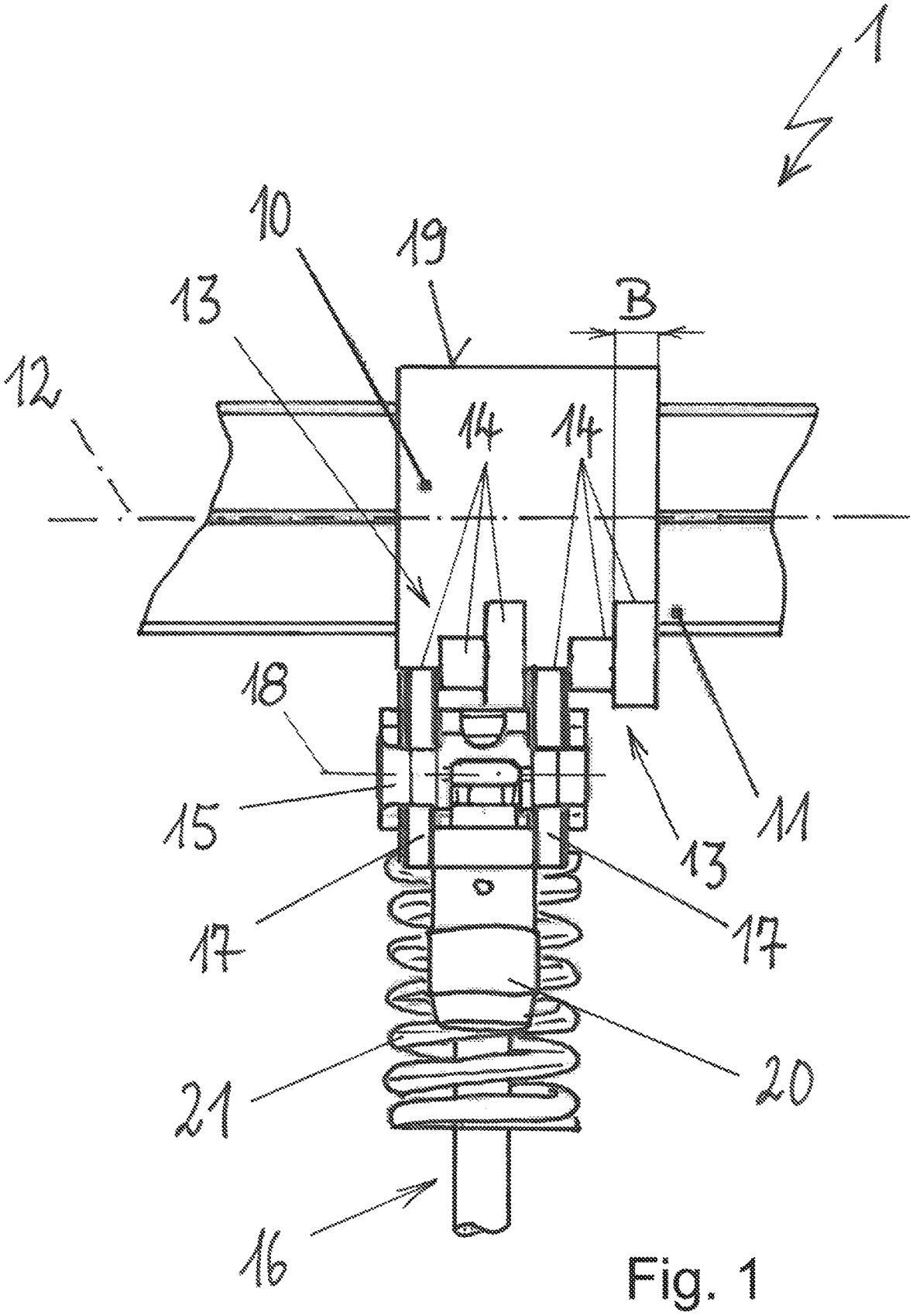
FIG. 1 is a side view of an example valve drive.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

An example object of the present disclosure is to further develop a valve drive having a sliding cam element on a carrier shaft. The sliding cam element can be displaced in a direction along an axis of rotation of the carrier shaft between different axial positions with short switching times. In particular, it is sought to shorten a displacement length in a direction of the axis of rotation without premature wear of the valve drive occurring. To that end, in some examples, the sliding cam element held on the carrier shaft may include at least one cam profile group with cam profile sections of mutually different form. The valve drive may also include a pick-off element by way of which a control movement can be picked off from the cam profile sections and transmitted to a valve.

The invention encompasses the technical teaching that, on the sliding cam element, there are formed at least two cam profile groups which are mutually identical and which, for the joint control of one valve, interact with a single pick-off element.

Here, the invention is based on the concept of dividing a required contact width between the cam profile sections of a cam profile group with a pick-off element into two individual widths. In this way, it is for example the case that the width of the individual cam profile sections of the cam profile group is halved, wherein mutually identical cam profile sections are in contact with a single pick-off element simultaneously. In this way, a twin sliding cam element is formed, and the adjustment speed of the sliding cam element in the direction of the axis of rotation is greatly increased owing to the shortened travel. In this way, it is also possible for the switching of the sliding cam element to take place even at higher rotational speeds of the camshaft, because the displacement length of the sliding cam element on the carrier shaft is shortened.

Here, the cam profile sections which are formed in pairwise fashion do not imperatively need to have a width half that of a conventional cam profile section with unitary contact between the cam profile section and a pick-off element for the control of a valve. An approximate halving is however possible because the width of the cam profile group can be approximately halved, while there are always two individual contact lines present between the pick-off element and the sliding cam element by way of mutually separately arranged cam profile sections, such that the forces that can be transmitted by way of in each case one contact point are approximately halved per cam profile section. By way of the linear contact between the cam profile section and the pick-off element, a line load is generated here which is approximately equal to a conventional pick-off configuration by way of one pick-off element with a continuous single contact line. A further advantage arises as a result of improved lateral tilting stability owing to the twofold support of the pick-off element on the sliding cam element.

In an advantageous embodiment, the pick-off element may have at least two rollers, wherein a first roller interacts with the cam profile sections of a first cam profile group, and wherein a second roller interacts with the cam profile sections of a second cam profile group. Here, the cam profile groups may be formed adjacent to one another, and so as to adjoin one another, on the sliding cam element, such that the sliding cam element is not made unnecessarily wider.

The rollers on the pick-off element may be held in a common roller axis and may have an identical diameter to one another. For example, the pick-off element may be in the form of a rocker lever, in particular a roller-type rocker lever, and the two rollers may be mounted parallel to one another on a common axis.

The rollers may interact with cam profile sections which have mutually identical cam contours, and furthermore, on the pick-off element, between the rollers, there may be formed an intermediate space which is of such a size that it corresponds at least to the width of a cam profile section or of two cam profile sections of a cam profile group. If, for example, the cam profile group has three different cam profile sections, it is necessary for the intermediate space between the rollers to be of at least such a width that two further cam profile sections which are temporarily not in contact with the pick-off element can lie between the rollers.

The cam profile sections may have a common cam base circle section which has, in particular, a diameter which is constant over the width of the sliding cam element. In this way, the change in position of the sliding cam element in the direction of the axis of rotation can be performed when the pick-off element runs on the cam base circle section, which is preferably of continuous form and thus free from shoulders and step changes in diameter.

Finally, the sliding cam element may be formed in one piece with the two cam profile groups, wherein the two cam profile groups also form a first contact section with a first pick-off element, and a further pair of cam profile groups may be mounted on the same sliding cam element, which controls a further valve by way of a further pick-off element. In this way, the required axial displacement travel in the direction of the axis of rotation of the sliding cam element is not enlarged, because both pick-off elements interact synchronously with their respective pairwise cam profile group.

Figure 2:
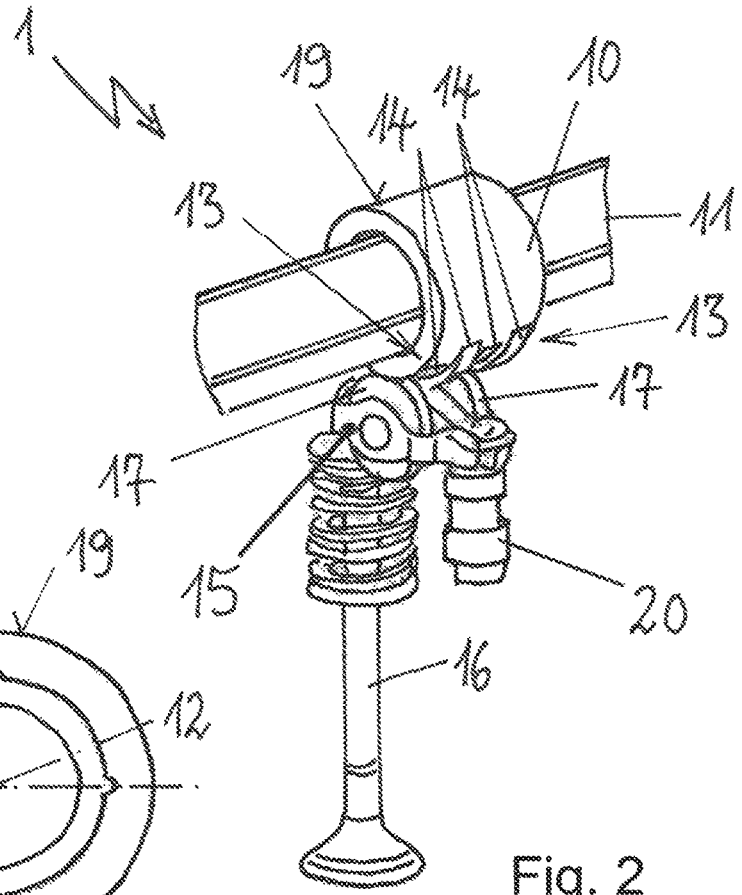
FIG. 2 is a perspective view of the valve drive of FIG. 1.
Figure 3:
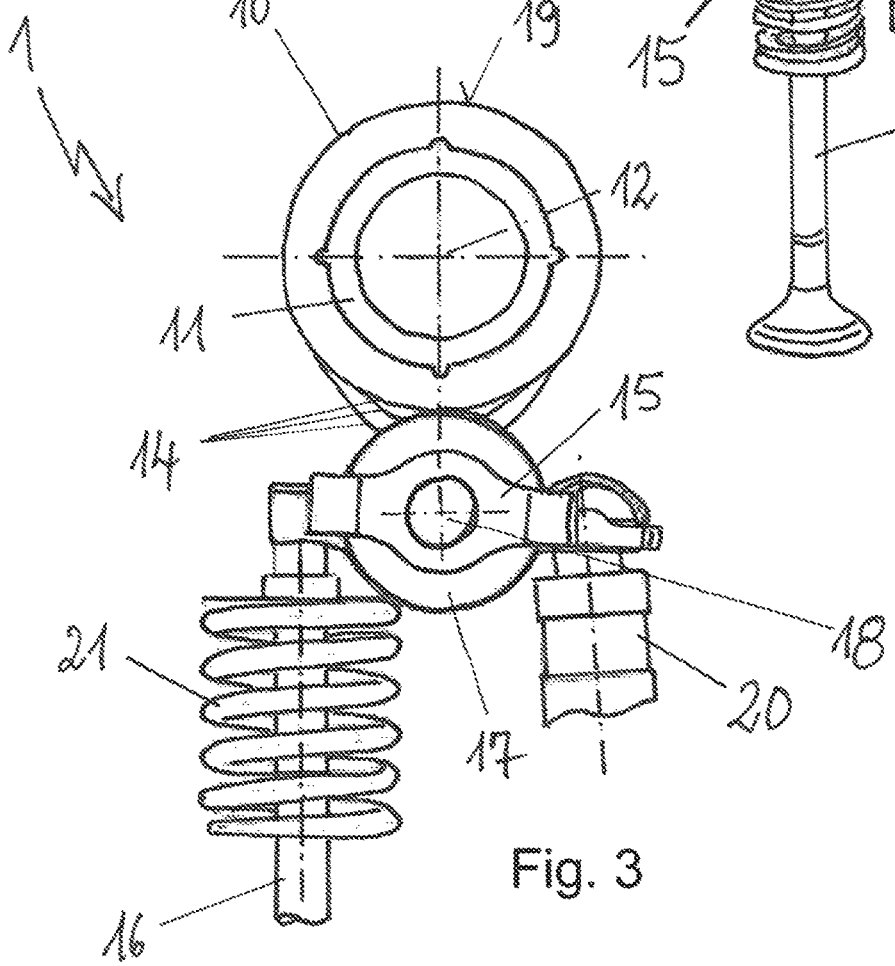
FIG. 3 is a side view of the valve drive of FIGS. 1-2.

FIGS. 1, 2 and 3 show the valve drive 1 with the features essential to the invention in second side views and in a perspective view. The valve drive 1 has a sliding cam element 10 which is formed in one piece and which is held on a carrier shaft 11 so as to be axially displaceable in an axis of rotation 12. The carrier shaft 11 is shown only in sections, and means (not shown in any more detail) may be provided on the sliding cam element 10 for the purposes of displacing said sliding cam element in the direction of the axis of rotation.

Two cam profile groups 13 of mutually identical form are formed on the sliding cam element 10. The cam profile groups 13 have, by way of example, three cam profile sections 14, wherein one cam profile section 14 is in the form of a zero-lift cam, and two further cam profile sections 14 are formed with different lift heights. Here, the cam profile sections 14 adjoin one another in the axial direction.

A pick-off element 15 interacts with the cam profile groups 13, which pick-off element transmits the lift information of the cam profile groups 13 to a valve 16. The valve 16 is furthermore shown as having a valve spring 21, and on that side of the pick-off element 15 which is situated opposite the valve 16, there is situated a support element 20 which can serve as a valve play compensation element and on which the pick-off element 15 is supported.

In the exemplary embodiment shown, the pick-off element 15 is in the form of a roller-type rocker lever with rollers 17 which are held on the main body of the pick-off element 15 in a common roller axis 18. The rollers 17 are held on the pick-off element 15 so as to be spaced apart from one another, and here, the spacing corresponds to the spacing of two cam profile sections 14 of identical form from the respective cam profile groups 13 of the sliding cam element 10. Thus, a twin contact configuration between the pick-off element 15 and the sliding cam element 10 is realized.

The cam profile sections 14 of the cam profile groups 13 are formed with a width B which is smaller than a required width of cam profile sections 14 if these form, with one of the two rollers 17, the pick-off contact for the control of a valve 16. For example, the width B of the cam profile sections 14 may be approximately half the magnitude of a width of cam profile sections which form an individual contact point with a pick-off element 15. The rollers 17, too, may have a width approximately half the magnitude of a width that would be required if only one roller 17 of a pick-off element 15 were in contact with a cam profile section 14 and picked off a lift movement therefrom.

Although the sliding cam element 10 has an overall width substantially equal to an overall width of a sliding cam element 10 with cam profile groups 13 of conventional form, the required axial displacement of the sliding cam element 10 in the direction of the axis of rotation is however reduced, because the cam profile sections 14 are narrower, and thus the travel in the direction of the axis of rotation by which the sliding cam element 10 must be displaced in order to perform a changeover of the pick-off of the rollers 17 between different cam profile sections 14 is reduced.

The actuation forces of the pick-off element 15 that are generated by the cam profiles of the cam profile sections 14 are divided equally between cam profile sections 14 which are of mutually identical form and which are in contact with the two rollers 17. Thus, a line load is generated at the contact line between the rollers 17 and the cam profile sections 14, which line load is of the same magnitude as if only one roller 17 were of relatively wide form and interacted with a single cam profile section 14 of an individual cam contour.

Owing to the relatively short axial travel for the adjustment of the sliding cam element 10, a changeover of cam profile sections 14 in contact with the roller 17 can be performed more quickly, wherein the changeover must always be performed when the roller 17 is in contact with the cam base circle section 19, which is provided on that side of the sliding cam element 10 which is situated opposite the cam profile groups 13. Thus, the sliding cam element 10 can be adjusted even at relatively high rotational speeds of the valve drive 1, for example above 4000 rpm.

The invention is not restricted in terms of its embodiment to the preferred exemplary embodiment specified above. Rather, numerous variants are conceivable which make use of the presented solution even in fundamentally different types of embodiment. All of the features and/or advantages which emerge from the claims, from the description or from the drawings, including design details or spatial arrangements, may be essential to the invention both individually and in a wide variety of combinations.

LIST OF REFERENCE DESIGNATIONS

1 Valve drive
10 Sliding cam element
Carrier shaft
12 Axis of rotation
13 Cam profile group
14 Cam profile section
15 Pick-off element
16 Valve
17 Roller
18 Roller axis
19 Cam base circle section
20 Support element
21 Valve spring
B Width

What is claimed is:

1. A valve drive comprising:

a sliding cam element that is disposed on a carrier shaft so as to be axially displaceable along an axis of rotation of the carrier shaft, wherein the sliding cam includes a first cam profile group with first cam profile sections of mutually different form and a second cam profile group with second cam profile sections of mutually different form, wherein the first cam profile sections have a same configuration as the second cam profile sections; and a pick-off element by way of which a control movement is picked off from the first and second cam profile sections and transmitted to a valve, wherein the two cam profile groups interact with the pick-off element to jointly control the valve.

2. The valve drive of claim 1 wherein the first and second cam profile groups are adjacent and adjoin one another on the sliding cam element.

3. The valve drive of claim 1 wherein a first roller of the pick-off element interacts with the first cam profile sections and a second roller of the pick-off element interacts with the second cam profile sections.

4. The valve drive of claim 3 wherein the first and second rollers are disposed along a common roller axis.

5. The valve drive of claim 3 wherein a diameter of the first roller is equal to a diameter of the second roller.

6. The valve drive of claim 3 wherein the first and second cam profile sections have mutually identical cam contours.

7. The valve drive of claim 3 wherein the pick-off element includes an intermediate space between the first and second rollers, wherein a size of the intermediate space corresponds to a width of one of the first cam profile sections.

8. The valve drive of claim 3 wherein the first roller of the pick-off element includes a first contact surface that interacts with the first cam profile sections, wherein the first roller is disc-shaped and is configured to rotate freely, wherein the first contact surface extends 360° around the disc-shaped first roller.

9. The valve drive of claim 1 wherein the first and second cam profile sections include a common cam base circle section that has a diameter that is constant over a width of the sliding cam element.

10. The valve drive of claim 1 wherein the pick-off element is configured as a rocker lever.

11. The valve drive of claim 1 wherein the sliding cam element is formed in one piece with the first and second cam profile groups.

12. The valve drive of claim 1 wherein the sliding cam element is integral with the first and second cam profile groups.

13. A valve drive comprising:

a sliding cam element disposed on a carrier shaft and axially displaceable along an axis of rotation of the carrier shaft, wherein the sliding cam includes a first cam profile group having different first cam profile sections, and a second cam profile group having different second cam profile sections, wherein the first cam profile sections have a same configuration as the second profile section; and a pick-off element by way of which a control movement is transferred from the first cam profile sections to a valve, wherein the first and second cam profile groups interacts with the pick-off element to jointly control the valve, wherein the pick-off element is disposed between and couples the valve and a support, wherein the first cam profile group engages with a central portion of the pick-off element located between the valve and the support.

14. The valve drive of claim 13 wherein the pick-off element is configured as a rocker lever.

15. The valve drive of claim 13 wherein the sliding cam element is integral with the first cam profile group.

16. The valve drive of claim 13 wherein the support and the valve are disposed on a first side of the pick-off element, wherein the sliding cam is disposed on a second side of the pick-off element, wherein the first side is opposite the second side.

17. A valve drive comprising:

a sliding cam element that is disposed on a carrier shaft so as to be axially displaceable along an axis of rotation of the carrier shaft, wherein the sliding cam includes a first cam profile group with first cam profile sections of mutually different form and a second cam profile group with second cam profile sections of mutually different form, wherein the first cam profile sections have a same configuration as the second cam profile sections; and a pick-off element by way of which a control movement is picked off from the first and second cam profile sections and transmitted to a valve, wherein the two cam profile groups engage with a portion of the pick-off element to jointly control the valve, wherein the portion of the pick-off element is configured to move in a same direction as the valve when the first and second cam profile sections move the pick-off element.

18. The valve drive of claim 17 wherein the pick-off element comprises a first roller disc and a second roller disc, wherein the first and second roller discs are freely rotatable, wherein the first roller disc engages with the first cam profile sections and the second roller disc engages with the second cam profile sections.

* * * * *